US012345121B1

(12) United States Patent
Wang et al.

(10) Patent No.: US 12,345,121 B1
(45) Date of Patent: Jul. 1, 2025

(54) ALL-METAL DISSOLVABLE BALL SEAT FOR SELF-COMPENSATING FRACTURING

(71) Applicant: CHONGQING YUHUA NEW MATERIALS TECHNOLOGY CO., LTD., Chongqing (CN)

(72) Inventors: Xiaohua Wang, Chongqing (CN); Shan Xu, Chongqing (CN); Zhou Zhang, Chongqing (CN); Jianhua Zhou, Chongqing (CN); Liang Ma, Chongqing (CN); Xiaogui Guo, Chongqing (CN); Xiaochen Qian, Chongqing (CN)

(73) Assignee: CHONGQING YUHUA NEW MATERIALS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 18/636,200

(22) Filed: Apr. 15, 2024

(30) Foreign Application Priority Data

Dec. 27, 2023 (CN) ..... 202311816320.X

(51) Int. Cl.
*E21B 33/128* (2006.01)
*E21B 33/129* (2006.01)
*E21B 43/26* (2006.01)

(52) U.S. Cl.
CPC ..... *E21B 33/128* (2013.01); *E21B 33/129* (2013.01); *E21B 43/26* (2013.01); *E21B 2200/08* (2020.05)

(58) Field of Classification Search
CPC ..... E21B 43/26; E21B 33/134; E21B 33/128; E21B 33/12; E21B 33/1285; E21B 33/129; E21B 23/00
See application file for complete search history.

(56) References Cited

U.S. PATENT DOCUMENTS 8,403,036 B2 * 3/2013 Neer ..... E21B 33/1216 166/134
2011/0024134 A1 * 2/2011 Buckner ..... E21B 33/1293 166/217
2011/0147015 A1 * 6/2011 Mickey ..... E21B 33/128 166/387
2014/0311752 A1 * 10/2014 Streich ..... E21B 33/134 166/376
2015/0013996 A1 * 1/2015 Davies ..... E21B 19/10 166/134
2016/0376869 A1 * 12/2016 Rochen ..... E21B 33/128 166/135

(Continued)

FOREIGN PATENT DOCUMENTS

CN 101787865 A 7/2010
CN 107724994 A * 2/2018

(Continued)

*Primary Examiner* — Daniel P Stephenson
(74) *Attorney, Agent, or Firm* — Porus IP LLC

(57) ABSTRACT

The present disclosure provides an all-metal dissolvable ball seat for self-compensating fracturing. The ball seat includes a tie rod, an expansion head, a sealing tube, a cone and a slip. The upper end of the tie rod is threadedly connected with a seating tool, and the lower end of the tie rod is connected with an internal thread of a base. The tie rod is located in the center of the shaft, and the locking joint, expansion head, sealing tube, cone, and slip are sequentially set on the tie rod.

3 Claims, 7 Drawing Sheets

(56) References Cited

U.S. PATENT DOCUMENTS

| | | | | |
|---|---|---|---|---|
| 2018/0073322 | A1* | 3/2018 | Davies | E21B 33/129 |
| 2019/0106961 | A1* | 4/2019 | Hardesty | E21B 33/128 |
| 2019/0352998 | A1* | 11/2019 | Wolf | E21B 33/12 |
| 2020/0040694 | A1* | 2/2020 | Hou | E21B 33/1293 |
| 2020/0072021 | A1* | 3/2020 | Zhao | E21B 29/00 |
| 2020/0157914 | A1* | 5/2020 | Graham | E21B 33/128 |
| 2020/0347694 | A1* | 11/2020 | Power | E21B 33/129 |
| 2021/0054704 | A1* | 2/2021 | Merron | E21B 33/124 |
| 2021/0238950 | A1* | 8/2021 | Keeling | E21B 33/128 |
| 2022/0120151 | A1* | 4/2022 | Jacob | E21B 33/124 |
| 2022/0136359 | A1* | 5/2022 | Nichols | E21B 34/063 166/373 |
| 2023/0203912 | A1* | 6/2023 | Zhong | E21B 33/129 166/123 |
| 2025/0059849 | A1* | 2/2025 | Malone | E21B 33/1285 |

FOREIGN PATENT DOCUMENTS

| | | | | |
|---|---|---|---|---|
| CN | 111677477 | A | * | 9/2020 |
| CN | 117703304 | A | * | 3/2024 |

* cited by examiner

ALL-METAL DISSOLVABLE BALL SEAT FOR SELF-COMPENSATING FRACTURING

CROSS-REFERENCE

This application claims priority to Chinese Application No. 202311816320.X, filed on Dec. 27, 2023, the entire contents of which are incorporated herein by reference.

TECHNICAL FIELD

The present disclosure relates to the technical field of oil and gas field development, and particularly to an all-metal dissolvable ball seat for self-compensating fracturing.

BACKGROUND

The fracturing ball seat used in the market mostly adopts a multi-valve structure. These valves form a cylinder after the ball seat is sealed. The outer cylindrical surface coincides with the inner wall of the casing, and the inner cylindrical surface has an inner conical angle. The ball seat needs to be sealed at first, that is, the position of the ball seat is fixed. During fracturing, a sphere is introduced into the casing to seal the hole in the center of the ball seat, and moves with the differential pressure until it falls on the ball seat to act as a seal. However, because this ball seat is formed by several valves, there is a gap between the valves, resulting in poor sealing. Especially during the sealing test in the chamber, it is difficult to conduct a high-pressure differential pressure test. When fracturing at the site, due to the large pump displacement, the differential pressure may be established through throttling. However, under high differential pressure, the leakage flow rate is high, leading to significant erosion and abrasion of the ball seat and increasingly serious leakage, which affects the fracturing effect.

Therefore, it is desirable to provide a ball seat with a simple structure and reliable sealing.

SUMMARY

One of the embodiments of the present disclosure provides an all-metal dissolvable ball seat for self-compensating fracturing, comprising a tie rod, a locking joint, an expansion head, a sealing tube, a cone and a slip, wherein an upper end of the tie rod is threadedly connected to a seating tool, and a lower end of the tie rod is connected to an internal thread of a base; the tie rod is located at a center of a shaft; the locking joint, the expansion head, the sealing tube, the cone and the slip are sequentially set on the tie rod; the expansion head is of a cylindrical structure, the upper end inner hole of the expansion head is an inner cone hole of the expansion head, the upper outer surface of the expansion head is a cylindrical surface, the lower outer surface of the expansion head is an outer cone surface of the expansion head; the lower end of the locking joint cooperates with the expansion head inner cone hole; the sealing tube is of a cylindrical structure, the interior of the sealing tube is provided with a first inner conical surface, a first inner cylinder, a second inner conical surface, and a second inner cylinder in order from the upper end to the lower end; the first inner conical surface and the second inner conical surface have the same taper angle; the upper end of the outer surface of the sealing tube is a sealing tube outer conical surface, and the lower end of the sealing tube is an outer cylinder; the first inner conical surface is set on the expansion head outer conical surface of the expansion head; the lower end of the sealing tube is sleeved within an tab with an annular shape at the upper end of the cone; the cone is of a cylindrical structure, the lower part of the cone is inserted into a conical hole at the upper end of the slip, making a plurality of cutouts uniformly cut along a circumferential direction of an outer surface of the slip; the tab at a lower end of the slip is limited by the bas.

In some embodiments, the expansion head, the sealing tube, the cone, the slip, and the base are made of magnesium-based and aluminum-based soft metal materials that are dissolvable in water.

In some embodiments, a plurality of grooves are disposed at an outer side of an outer conical surface of the sealing tube.

BRIEF DESCRIPTION OF THE DRAWINGS

The present disclosure will be further illustrated by way of exemplary embodiments, which will be described in detail with reference to the accompanying drawings. These embodiments are not limiting, and in these embodiments, the same numbering denotes the same structure, wherein.

DETAILED DESCRIPTION

Figure 1:
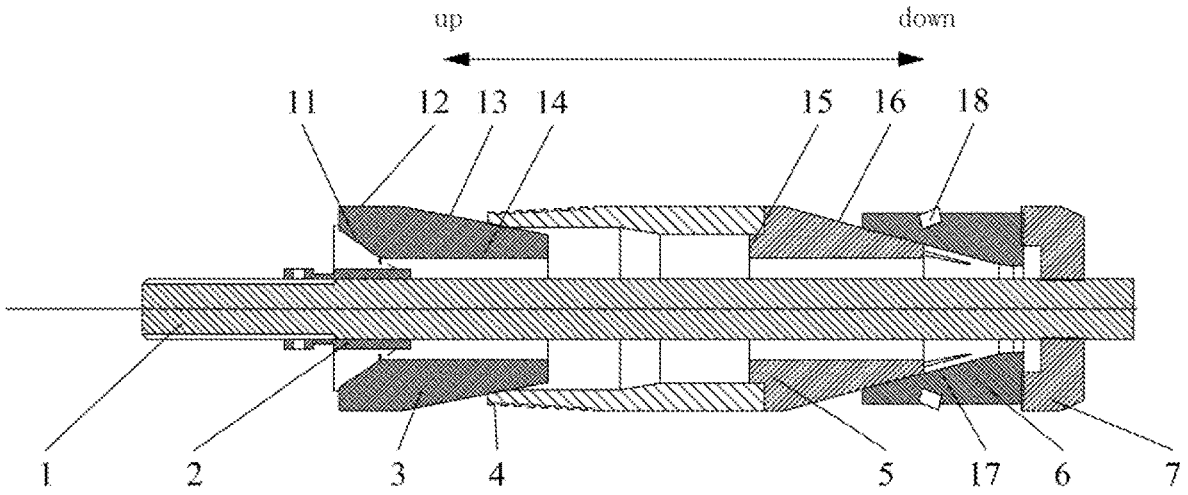
FIG. 1 is a cross-sectional view of an all-metal dissolvable ball seat for self-compensating fracturing, as shown in some embodiments of the present disclosure.

In order to more clearly illustrate the technical solutions of the embodiments of the present disclosure, the accompanying drawings required to be used in the description of the embodiments are briefly described below. Obviously, the accompanying drawings in the following description are only some examples or embodiments of the present disclosure, and it is possible for a person of ordinary skill in the art to apply the present disclosure to other similar scenarios in accordance with the accompanying drawings without creative labor. The present disclosure can be applied to other similar scenarios based on these drawings without creative labor. Unless obviously obtained from the context or the context illustrates otherwise, the same numeral in the drawings refers to the same structure or operation.

As shown in the present disclosure and the claims, unless the context clearly suggests an exception, the words "one," "a", "an", and/or "the" do not refer specifically to the singular, but may also include the plural. Generally, the terms "including" and "comprising" suggest only the inclusion of clearly identified steps and elements. In general, the terms "including" and "comprising" only suggest the inclusion of explicitly identified steps and elements that do not constitute an exclusive list, and the method or apparatus may also include other steps or elements.

The following specific embodiments of the present disclosure are described in further detail in conjunction with the accompanying drawings and embodiments. The following embodiments are used to illustrate the embodiments of the present disclosure, but are not intended to limit the scope of the embodiments of the present disclosure.

FIG. 1 is a cross-sectional view of an all-metal dissolvable ball seat for self-compensating fracturing shown in some embodiments of the present disclosure.

As shown in FIG. 1, in some embodiments, an all-metal dissolvable ball seat for self-compensating fracturing (hereinafter referred to as a "ball seat") includes a tie rod 1, a locking joint 2, an expansion head 3, a sealing tube 4, a cone 5, a slip 6, and a base 7. Tie rod 1 may be used for removal and installation of the ball seat. The tie rod 1 may be metallic. In some embodiments, the upper end of the tie rod 1 may be connected to a seating tool, and the lower end may be connected to the base 7. For example, the upper end of the tie rod 1 is threaded to the seating tool, and the lower end of the tie rod 1 is internally threaded to the base 7. In some embodiments, the locking joint 2, the expansion head 3, the sealing tube 4, the cone 5, and the slip 6 are sequentially assembled on the tie rod 1. It should be noted that hereinafter "upper end" or "upper portion" refers to an end of the ball seat away from the base 7, and "lower end" or "lower portion" refers to an end of the ball seat close to the base 7. Specifically, the "upper" (or "up") and "lower" (or "down") directions can be referred to labels in the appendix.

In some embodiments, the locking joint 2 may be fixedly coupled to the tie rod 1 and tightly fitted to the expansion head 3. The locking joint 2 may be metallic. In some embodiments, the locking joint 2 may be threaded to the tie rod 1, with the tapered surface of the locking joint 2 abutting the tapered surface of the expansion head 3. The upper portion of the sealing tube 4 is fitted onto the tapered surface of the expansion head 3, and the lower portion of the sealing tube 4 is fitted onto the cone 5. The slip 6 is assembled to fit the tapered surface of the cone 5, and the base 7 is fitted onto the tie rod 1, with the tie rod 1 connected to the base 7 via threads.

In some embodiments, when the ball seat is sealed, the base 7 may remain stationary with the tie rod 1, while the expansion head 3, the sealing tube 4, and the cone 5 move downward together, and the slip 6 radially expands on the lower end surface of the cone 5. The sealing tube 4 and the cone 5 stop moving, while the expansion head 3 continues to move downward. The sealing tube 4 expands outward along the conical surface of the expansion head 3. The sealing tube 4 expands outward along the conical surface of the expansion head 3, inflating to the inner wall of a casing 28 (refer to FIG. 5). Under the sealing force of the ball seat, the expansion head 3 enters into the sealing tube 4, the sealing tube 4 fills the space between the inner wall of the casing 28 and the cylindrical surface 12 of the expansion head 3, thus achieving a seal. After the ball seat is sealed, a dissolvable ball is placed on the expansion head inner cone hole 11, thereby completing the sealing of the ball seat. In some embodiments, after the ball seat is formed, the tie rod 1 and the locking joint 2 may be lifted out of the well along with the sealing tool, while the other components of the ball seat can be discarded in the well. The discarded components are designed to dissolve automatically after the fracturing process is completed.

The expansion head 3 serves as a supporting structure for the sphere when sealing. As shown in FIG. 1, in some embodiments, the expansion head 3 may have a cylindrical structure, with the upper end inner hole of the expansion head 3 serving as the expansion head inner cone hole 11 (also referred to as inner cone hole 11 of the expansion head), the upper outer surface of the expansion head 3 as the cylindrical surface 12, the lower end inner hole of the expansion head 3 as the through-hole 14, and the lower outer surface of the expansion head 3 as the expansion head outer conical surface 13 (also referred to as outer conical surface 13 of the expansion head). In some embodiments, the contraction end of the expansion head inner cone hole 11 faces downward. In some embodiments, the contraction end of the expansion head inner cone hole 11 has the same diameter as the internal diameter of the through-hole 14.

When it is necessary to seal the casing 28 in which the ball seat is sealed, the soluble metal sphere used for sealing is put into the fracturing well, moves to the expansion head 3, and is seated on the expansion head inner cone hole 11 of the expansion head, whereupon sealing is completed. In some embodiments, the lower outer surface of the sphere may be machined to be tapered and to have the same taper angle (or cone angle) as the expansion head inner cone hole 11 to increase the effectiveness of the seal.

In some embodiments, the lower end of the locking joint 2 may match with the expansion head inner cone hole 11. Exemplarily, as shown in FIG. 1, the lower external surface of the locking joint 2 is conical, with the cone angle the same as that of the expansion head inner cone hole 11, allowing the lower external surface of the locking joint 2 to closely adhere to the expansion head 3.

Figure 2:
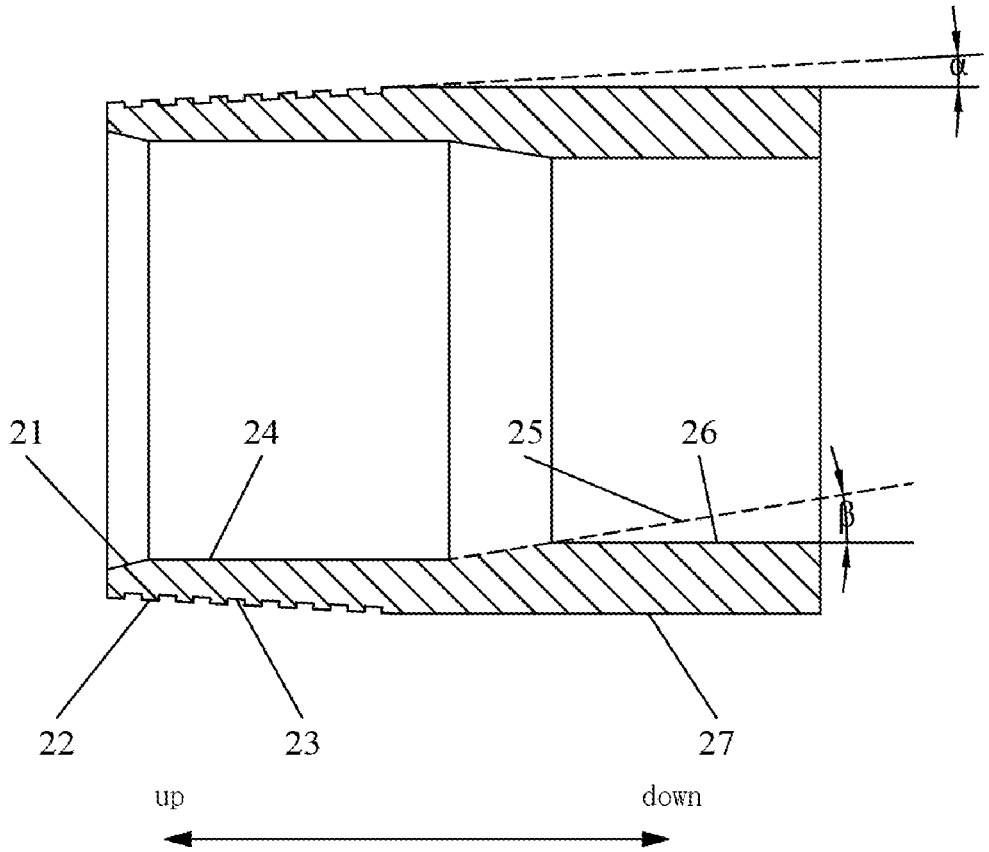
FIG. 2 is a cross-sectional view of a sealing tube shown in some embodiments of the present disclosure.

FIG. 2 is a cross-sectional view of the sealing tube shown in some embodiments of this disclosure.

As shown in FIG. 2, the sealing tube 4 is the main component that acts as a seal. In some embodiments, the sealing tube 4 may be of a cylindrical structure, and the interior of the sealing tube 4 has, in order from the upper end to the lower end, a first inner conical surface 21, a first inner cylinder 24, a second inner conical surface 25, and a second inner cylinder 26.

In some embodiments, the first inner conical surface 21 and the second inner conical surface 25 may have the same conical angle. In some embodiments, the upper end of the outer surface of the sealing tube 4 is the sealing tube outer conical surface 22 and the lower end of the sealing tube 4 is the outer cylinder 27. In some embodiments, the sealing tube outer conical surface 22 has an angle $\alpha$ of 1°-5°; the first inner conical surface 21 has an angle $\beta$ of 5°-15°. In some embodiments, the sealing tube outer conical surface 22 has an angle $\alpha$ of 1°-3°; the first inner conical surface 21 has an angle $\beta$ of 5°-10°. In some embodiments, the sealing tube outer conical surface 22 has an angle $\alpha$ of 1°-2°; the first inner conical surface 21 has an angle $\beta$ of 5°-8°. In some embodiments, the sealing tube outer conical surface 22 has an angle $\alpha$ of 2°-5°; the first inner conical surface 21 has an angle $\beta$ of 10°-15°. In some embodiments, the sealing tube outer conical surface 22 has an angle $\alpha$ of 3°-5°; the first inner conical surface 21 has an angle $\beta$ of 8°-15°. In some embodiments, the sealing tube outer conical surface 22 has an angle $\alpha$ of 2°-4°; the first inner conical surface 21 has an angle $\beta$ of 8°-12°. In some embodiments, the sealing tube outer conical surface 22 has an angle $\alpha$ of 3°-4°; the first inner conical surface 21 has an angle $\beta$ of 10°-13°. Setting up in this way enables the expansion head 3 to squeeze into the sealing tube 4 more smoothly.

In some embodiments, the inner diameter of the upper end of the sealing tube 4 may be greater than the minimum outer diameter of the expansion head outer conical surface 13 and less than the outer diameter of the cylindrical surface 12, and the first inner conical surface 21 matches with the expansion head outer conical surface 13 of the lower part of the expansion head 3. Set up in this way, when the ball seat is sealed, the expansion head 3 and the sealing tube 4 move relatively, so that when the lower end of the expansion head 3 is pushed and squeezed to enter the casing 28 at the upper end of the sealing tube 4, the lower end of the expansion head 3 is able to enter the sealing tube 4 smoothly. As the expansion head 3 moves downward, the expansion head outer conical surface 13 gradually squeezes and expands the upper end of the sealing tube 4, and the outer diameter of the first inner conical surface 21 continues to expand outward. At the same time, the outer diameter of the sealing tube outer conical surface 22 also continues to expand. When the outer diameter of the sealing tube outer conical surface 22 expands to be equal to the inner diameter of the casing 28, the expansion head 3 continues to move forward under the sealing force and enters the sealing tube 4 along the inner hole of the sealing tube 4. The expansion head 3 squeezes the sealing tube 4 between the inner wall surface of the casing 28 and the cylindrical surface 12 of the expansion head 3, making the sealing tube 4 gradually fill the gap between the expansion head 3 and the casing, and play a sealing role.

Because the upper outer surface of the sealing tube 4 is the sealing tube outer conical surface 22 (also referred to as the outer conical surface 22 of the sealing tube), and the outer diameter of the conical surface gradually increases from top to bottom, the lengths of the expansion head 3 entering the sealing tube 4 are different for casings with different inner diameters, and the sizes of the casing inner diameters are proportional to the distances of the expansion head 3 squeezing into the sealing tube 4. Therefore, the combination of the sealing tube 4 and the expansion head 3 can be adapted to various casing 28 with different inner diameters in the process of oil and gas fracturing.

In some embodiments, a plurality of grooves 23 may also be provided on the outer side of the sealing tube outer conical surface 22, and the grooves 23 may be arranged in an annular shape on the sealing tube outer conical surface 22. The grooves 23 are provided to facilitate the expansion of the sealing tube outer conical surface 22 when the ball seat is sealed, and the grooves 23 can enhance the sealing between the sealing tube 4 and the inner wall of the casing 28 after the sealing tube 4 is extruded and deformed to fit the inner wall of the casing 28.

Figure 3:
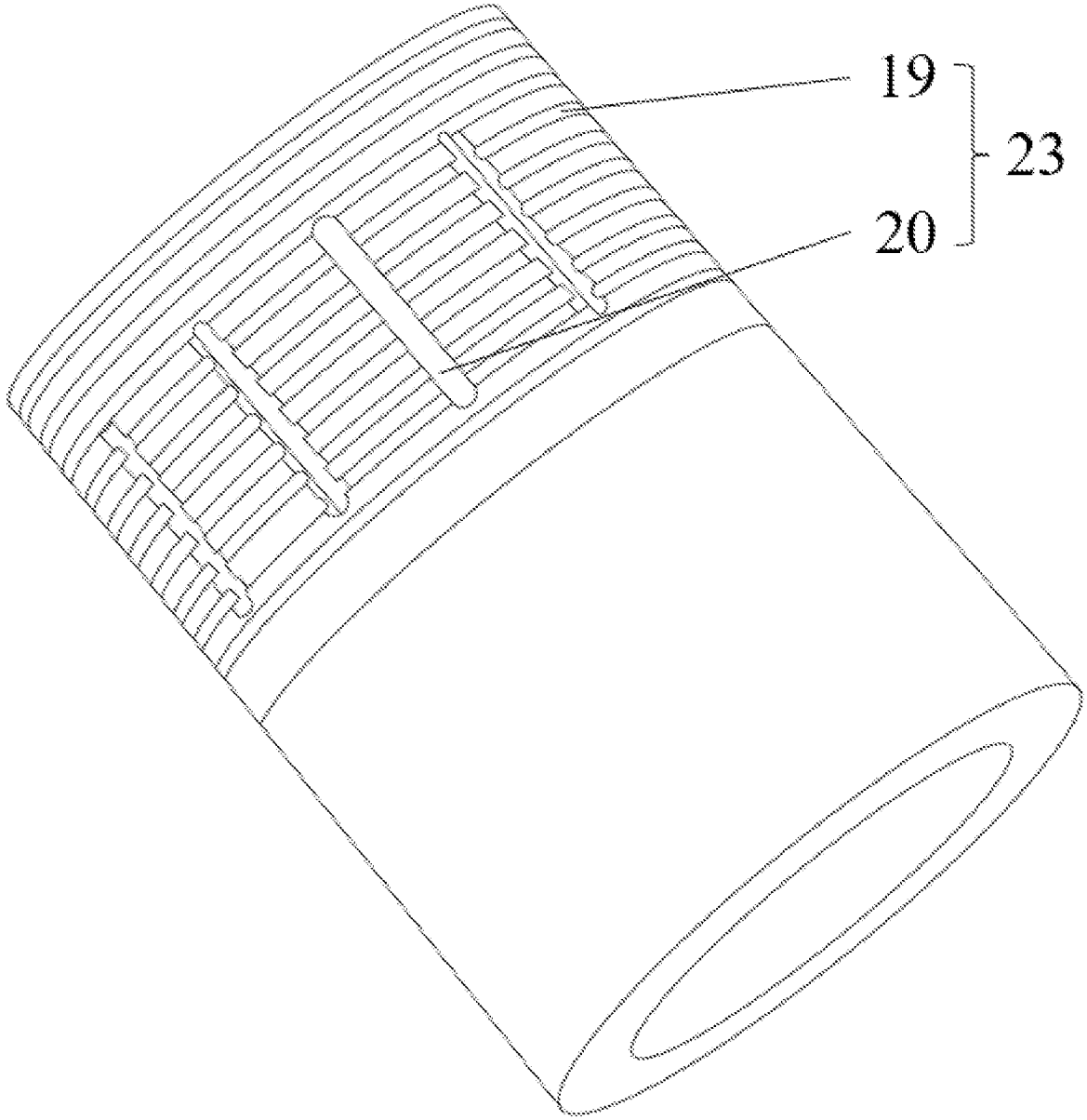
FIG. 3 is a schematic diagram of a structure of the sealing tube shown in some embodiments of the present disclosure.

FIG. 3 is a schematic diagram of the structure of the sealing tube in some embodiments of this document.

As shown in FIG. 3, in some embodiments, the grooves 23 may include multiple annular depressions 19 distributed along the circumferential direction of the sealing tube 4, and multiple recesses 20 distributed along the extension direction of the sealing tube 4. Among them, multiple annular depressions 19 can be evenly distributed on the sealing tube outer conical surface 22 and multiple recesses 20 can be evenly spaced on the sealing tube outer conical surface 22. In some embodiments, the annular depressions 19 may have the same depths as the recesses 20. In some embodiments, as shown in FIG. 3, the recesses 20 may have greater depths than the annular depressions 19. In some embodiments, the length of each of the annular depressions 19 is shorter than the circumferential length of the sealing tube 4, that is, the annular depressions 19 can be non-fully wrapped around the sealing tube outer conical surface 22 and multiple annular depressions 19 can be displaced along the extension direction of the sealing tube 4, and the spacing between adjacent annular depressions 19 is equal. By displacing the annular depressions 19, the sealing tube 4 can have a certain degree of bending and elasticity in the circumferential direction, thus being able to adapt to casings of different shapes, such as the casing 28 with an elliptical cross-section.

By setting multiple annular depressions 19 and multiple recesses 20 to form the grooves 23 on the sealing tube 4, the sealing tube 4 is easier to expand during sealing, reducing the sealing pressure while maintaining good sealability.

In some embodiments, the distance from the upper part of the grooves 23 to the upper surface of the sealing tube 4 is 20-30 mm, and the length of the grooves 23 extending along the extension direction of the sealing tube 4 is 15-20 mm. In some embodiments, the distance from the upper part of the grooves 23 to the upper surface of the sealing tube 4 is 20-25 mm, and the length of the grooves 23 extending along the extension direction of the sealing tube 4 is 15-18 mm. In some embodiments, the distance from the upper part of the grooves 23 to the upper surface of the sealing tube 4 is 20-23 mm, and the length of the grooves 23 extending along the extension direction of the sealing tube 4 is 15-16 mm. In some embodiments, the distance from the upper part of the grooves 23 to the upper surface of the sealing tube 4 is 25-30 mm, and the length of the grooves 23 extending along the extension direction of the sealing tube 4 is 18-20 mm. In some embodiments, the distance from the upper part of the grooves 23 to the upper surface of the sealing tube 4 is 23-30 mm, and the length of the grooves 23 extending along the extension direction of the sealing tube 4 is 17-20 mm. In some embodiments, the distance from the upper part of the grooves 23 to the upper surface of the sealing tube 4 is 24-27 mm, and the length of the grooves 23 extending along the extension direction of the sealing tube 4 is 16-19 mm. In some embodiments, the distance from the upper part of the grooves 23 to the upper surface of the sealing tube 4 is 26-28 mm, and the length of the grooves 23 extending along the extension direction of the sealing tube 4 is 17-18 mm.

The following combines the drawings to exemplify the self-compensating sealing principle of the self-compensating fracturing full metal soluble ball seat applied to casings of different specifications in some embodiments of this document.

Figure 4A:
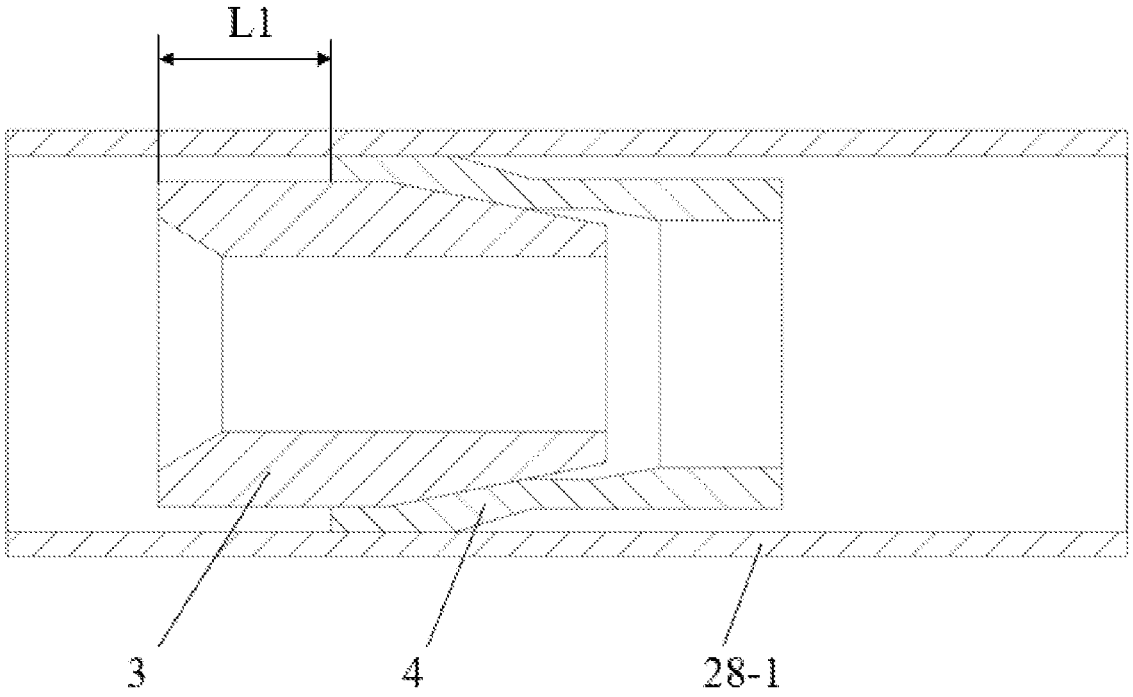
FIG. 4*a* is a schematic diagram of a self-compensating sealing principle of the sealing tube as shown in some embodiments of the present disclosure.
Figure 4B:
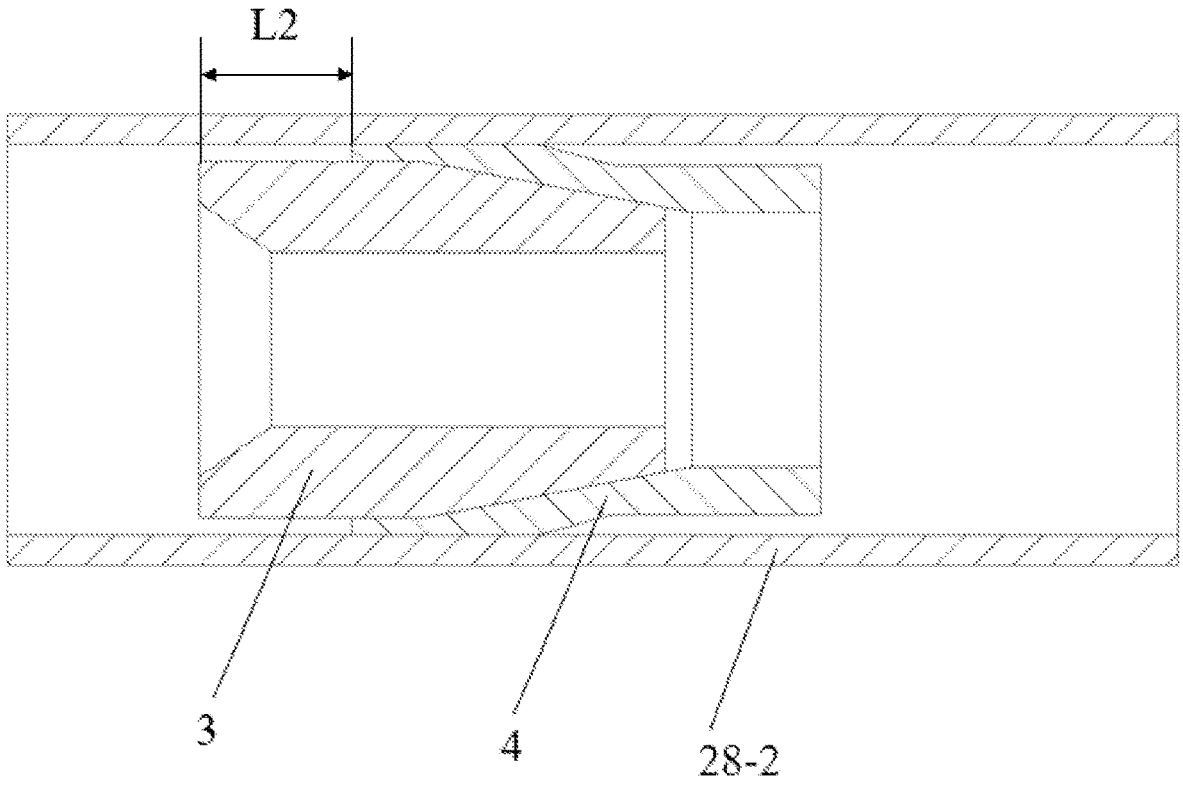
FIG. 4*b* is a schematic diagram of a self-compensating sealing principle of the sealing tube as shown in some embodiments of the present disclosure.

FIG. 4*a* is a schematic diagram of a self-compensating sealing principle of the sealing tube as shown in some embodiments of the present disclosure. FIG. 4*b* is a schematic diagram of a self-compensating sealing principle of the sealing tube as shown in some embodiments of the present disclosure.

For example, as shown in FIG. 4*a* and FIG. 4*b*, the first casing 28-1 and the second casing 28-2 are two casings of different specification, with the inner diameter of the first casing 28-1 being smaller than that of the second casing 28-2. As shown in FIG. 4*a*, after the ball seat is sealed, the expansion head 3 moves to the inner cavity of the sealing tube 4, and the sealing tube 4 fills the annular space between the inner wall of the first casing 28-1 and the outer cylinder of the expansion head 3, thus forming a seal. The action process shown in FIG. 4*b* is the same as that in FIG. 4*a* and is not repeated.

Since the inner diameter of the first casing 28-1 is smaller than that of the second casing 28-2, the distance that the expansion head 3 enters the inner cavity of the sealing tube 4 shown in FIG. 4*a* is smaller, hence the length L1 between the upper surface of the sealing tube 4 and the upper end of the expansion head 3 is larger. Similarly, since the inner diameter D2 of the second casing 28-2 is larger than the inner diameter of the first casing 28-1, the distance that the expansion head enters the inner cavity of the sealing tube 4 shown in FIG. 4*b* is larger, making the length L2 between the upper surface of the sealing tube 4 and the upper end of the expansion head 3 smaller.

The following combines the drawings to exemplify the sealing principle of the sealing tube 4.

Figure 5:
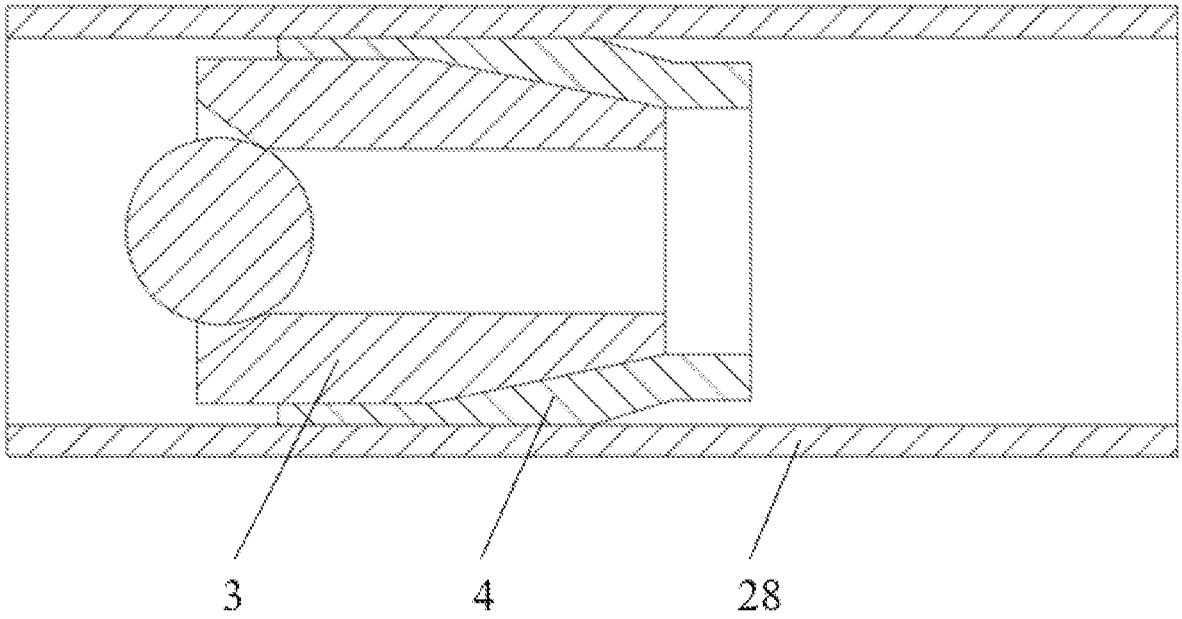
FIG. 5 is a schematic diagram of a secondary sealing principle of the sealing tube as shown in some embodiments of the present disclosure.

FIG. 5 is a schematic diagram of a secondary sealing principle of the sealing tube as shown in some embodiments of the present disclosure.

For example, as shown in FIG. 5, the diameter of the first inner cylinder 24 of the sealing tube 4 is larger than the diameter of the second inner cylinder 26. For example, the diameter of the first inner cylinder 24 is 5-8 mm larger than the diameter of the second inner cylinder 26. For another example, the diameter of the first inner cylinder 24 is 5-7 mm larger than the diameter of the second inner cylinder 26. For yet another example, the diameter of the first inner cylinder 24 is 5-6 mm larger than the diameter of the second inner cylinder 26. For yet another example, the diameter of the first inner cylinder 24 is 6-8 mm larger than the diameter of the second inner cylinder 26. For yet another example, the diameter of the first inner cylinder 24 is 7-8 mm larger than the diameter of the second inner cylinder 26. For yet another example, the diameter of the first inner cylinder 24 is 6-7 mm larger than the diameter of the second inner cylinder 26.

When the ball seat is sealed under the action of sealing force, the expansion head 3 enters the first inner cylinder 24 of the sealing tube 4, and due to the limited sealing force provided by the sealing tool, the expansion head outer conical surface 13 cannot contact the second inner conical surface 25 of the sealing tube 4, completing the initial seal after the ball seat is sealed. When fracturing is to be carried out, a dissolvable sealing ball is placed on the first inner conical surface 21 of the expansion head 3, and the fracturing starts from the wellhead. At this time, the expansion head 3 is subjected to a downward pressure much greater than the sealing force provided by the sealing tool, causing the expansion head 3 to continue moving downwards. The expansion head outer conical surface 13 contacts the second inner conical surface 25 of the sealing tube 4, expanding the second inner cylinder 26 of the sealing tube 4 as well as the outer cylinder 27 at the lower end of the sealing tube 4 outward, pressing the outer cylinder 27 at the lower end of the sealing tube 4 into the inner wall of the casing 28. Since the diameter of the second inner cylinder 26 at the lower end of the sealing tube 4 is smaller, pressing the sealing tube 4 into the inner wall of the casing 28 generates greater contact pressure, significantly improving the sealing performance of the ball seat.

The cone 5 is an intermediate structure of the ball seat. In some embodiments, the cone 5 may be a barrel-like structure, and the upper end of the cone 5 has a tab 15. The tab 15 is circular in shape, the outer diameter of the tab 15 may be the same as the diameter of the second inner cylinder 26 of the sealing tube 4, allowing the lower end of the sealing tube 4 to be fitted onto the tab 15 of the cone 5. In some embodiments, the lower end of the cone 5 has a cone conical surface 16.

Figure 6:
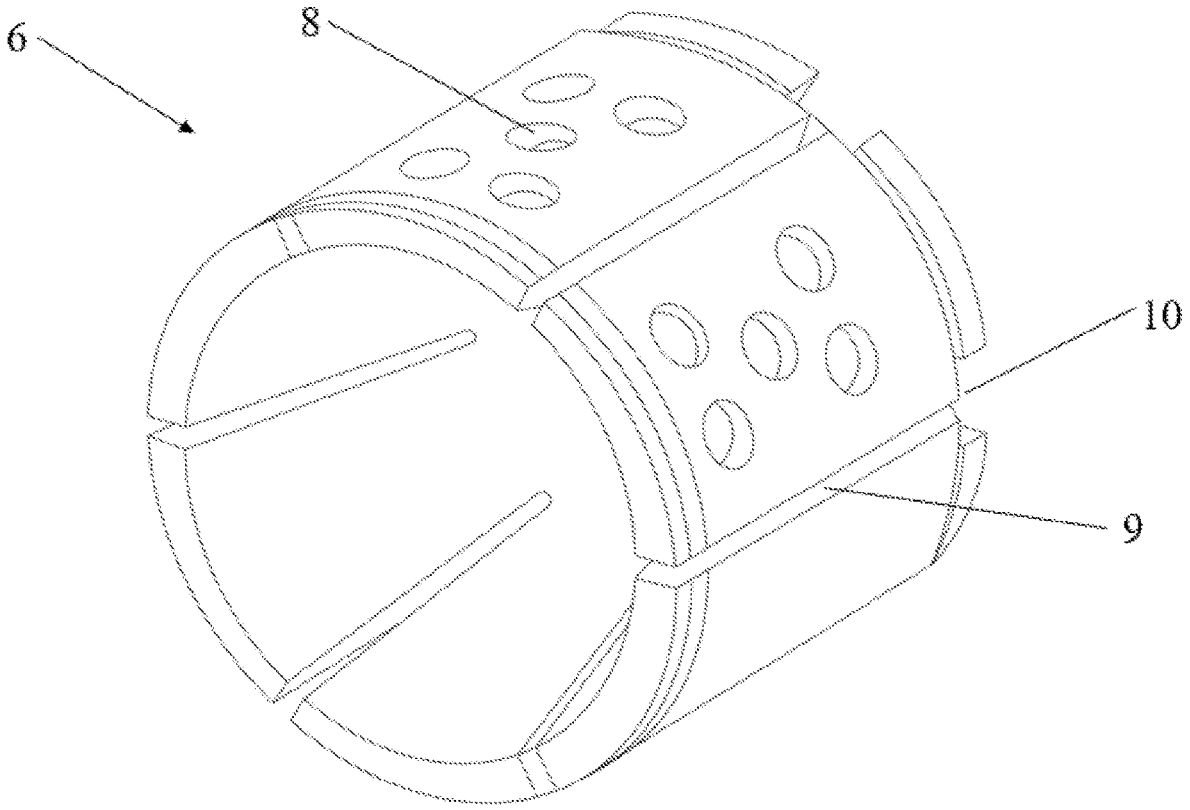
FIG. 6 is a schematic diagram of a structure of the slip as shown in some embodiments of the present disclosure.

FIG. 6 is a schematic diagram of a structure of the slip as shown in some embodiments of the present disclosure.

The slip 6 is a mechanism that secures the ball seat to the casing 28. In some embodiments, the slip 6 has a cylindrical structure. An upper end of the slip 6 has a conical hole 17. The cone angle of this hole is the same as the cone angle of the cone conical surface 16 of the cone 5, allowing the lower part of the cone 5 to insert into the conical hole 17 at the upper end of the slip 6, making the conical hole 17 have a tight fit with the cone conical surface 16. In some embodiments, as shown in FIG. 6, the outer surface of the slip 6 may be cylindrical, with multiple cutouts 9 uniformly arranged along an extension direction of the outer surface, and multiple recesses 10 at a lower end of the slip 6. In some embodiments, the cutouts 9 gradually decrease in width from the upper to the lower end of the slip 6. By providing a plurality of cutouts 9, the cut-outs can be cracked as the slip 6 crawls along the cone conical surface 16, and the plurality of recesses 10 in the lower end surface of the slip 6 ensures that the slip 6 can be evenly cracked.

In some embodiments, the outer surface of the slip 6 is provided with multiple anchor teeth 18, which dig into the inner wall of the casing 28 as the slip 6 expands, making the casing 28 and the slip 6 fixed together, thus stabilizing the entire ball seat. In some embodiments, the outer surface of the slip 6 may have multiple anchor teeth holes 8, the anchor teeth 18 fixedly mounted within anchor teeth holes 8. In some embodiments, the lower end surface of the slip 6 is equipped with several recesses, a count of which is the same as a count of tabs on the upper end surface of the base 7, the tabs on the upper end surface of the base 7 are matched into the recesses at the lower end surface of the slip 6.

In some embodiments, the base 7 may be in the shape of a cylinder, an upper end of the base 7 is provided with a plurality of projections matching the recesses of the slip 6, a threaded hole may be provided on the base 7, and a lower end of the tie rod 1 is threadedly coupled to the base 7 through the threaded hole. In some embodiments, when the seating force reaches a certain level, the internal threads connected between the base 7 and the tie rod 1 are removed by shearing, and the tie rod 1, the locking joint 2, and the seating tool are able to be removed together.

In some embodiments, the expansion head 3, the sealing tube 4, the cone 5, the slip 6, and the base 7 are made of magnesium-based, aluminum-based, soft metal materials that are soluble in water. The soft material enables better deformation of the various parts of the seat when subjected to extrusion, and its good ductility can adequately fill in the gap between the ball seat and the casing, enhancing the sealing during fracturing. And the water-soluble metal material can automatically dissolve after the completion of fracturing. For example, after the completion of a fracturing operation, the remaining components of the ball seat can dissolve in water, thereby freeing up the space within the casing, facilitating the re-entry of the ball seat for subsequent fracturing operations.

In some embodiments, the material hardness of the expansion head 3 and the cone 5 can be greater than that of the sealing tube 4 and the slip 6, respectively. For example, if the Vickers hardness of the expansion head 3 is 100, then the Vickers hardness of the sealing tube 4 should be less than 100. The higher material hardness of the expansion head 3 and the cone 5 ensures their strength, preventing deformation towards the center of the casing 28 due to compression.

In some embodiments, when the ball seat is sealed, the base 7 may remain stationary with the tie rod 1, while the expansion head 3, the sealing tube 4, and the cone 5 move downward together. The slip 6 expands radially along the lower end surface of the cone 5. Once the anchor teeth 18 on the outer periphery of the slip 6 engage a certain depth into the inner wall of the casing, the anchoring of the bridge plug is completed. The sealing tube 4 and the cone 5 stop moving, allowing the expansion head 3 to continue downward, pressing inwardly against the upper end of the sealing tube 4. This forces the soft sealing tube 4 to expand outward along the conical surface of the expansion head 3. Meanwhile, the expansion head 3 and the inner wall of the casing jointly compress the sealing tube 4 from the inside and outside, filling the space between the inner wall of the casing and the cylindrical surface 12 of the expansion head 3 to provide a sealing effect. After the ball seat is sealed, the soluble sphere is positioned on the expansion head inner cone hole 11 of the upper end of the expansion head 3 to complete the ball seat seal. In this configuration, the ball seat has a wide temperature adaptability range and provides a good sealing effect without the need for rubber-assisted sealing. The actions of seating sealing and anchoring are separate and do not interfere with each other, making the operation more reliable. Furthermore, the size of the sealing tube is variable, providing stronger adaptability to uneven casing wall thickness.

Furthermore, the indicated orientations or positional relationships described in the embodiments of the present disclosure are based on the orientations or positional relationships shown in the accompanying drawings, and are intended only for the purpose of facilitating the description of the embodiments of the present disclosure and to simplify the description, and are not intended to indicate or to imply that the referred devices or constructions must have a particular orientation or operate in a particular orientation configuration, and therefore are not to be construed as limitations on the embodiments of the present disclosure.

In the embodiments of the present disclosure, unless otherwise expressly provided and limited, the terms "connect", "provide" and other terms should be understood broadly, e.g., it can be a fixed connection, a removable connection, or an integration unit; it can be a mechanical connection or an electrical connection; it can be a direct connection or an indirect connection through an intermediate medium; or it can be a connection between two components or an interactive relationship between the two components. For those of ordinary skill in the art, the specific meanings of the above terms in the embodiments of the present disclosure may be understood on a case-by-case basis. A component may be directly on another component or indirectly on another component. When a component is said to be "attached", "connect", "linked" to another component, it may be attached directly to the component or indirectly to the component.

It is important to understand that the terms "length", "width", "top", "bottom", "front", "back", "left", "right", "vertical", "horizontal", "top", "bottom", "inside", "outside", etc. indicate orientations or positional relationships based on those shown in the accompanying drawings, and are intended only to facilitate description of the embodiments of the present disclosure and to simplify the description, and are not intended to indicate or imply that the referenced device or components must have a particular orientation, be constructed and operated in a particular orientation, and therefore are not to be construed as limitations on the embodiments of the present disclosure.

The foregoing is only a preferred embodiment of the embodiments of the present disclosure, and is not intended to be used to limit the embodiments of the present disclosure. It should be pointed out that, for the person of ordinary skill in the art, without departing from the technical principles of the embodiments of the present disclosure, several improvements and variations may also be made. It should be noted that for those of ordinary skill in the art, without departing from the technical principles of the embodiments of this disclosure, improvements and variations can be made, which should also be regarded as the scope of protection of the embodiments of this disclosure.

The basic concepts have been described above, and it is apparent to those skilled in the art that the foregoing detailed disclosure serves only as an example and does not constitute a limitation of this disclosure. While not expressly stated herein, a person skilled in the art may make various modifications, improvements, and amendments to this disclosure. Those types of modifications, improvements, and amendments are suggested in this disclosure, so those types of modifications, improvements, and amendments remain within the spirit and scope of the exemplary embodiments of this disclosure.

Finally, it should be understood that the embodiments described in this disclosure are only used to illustrate the principles of the embodiments of this disclosure. Other deformations may also fall within the scope of this disclosure. As such, alternative configurations of embodiments of the present disclosure may be considered to be consistent with the teachings of the present disclosure as an example, not as a limitation. Correspondingly, the embodiments of the present disclosure are not limited to the embodiments expressly presented and described herein.

What is claimed is:

1. An all-metal dissolvable ball seat for self-compensating fracturing, comprising a tie rod, a locking joint, an expansion head, a sealing tube, a cone and a slip, wherein an upper end of the tie rod is threadedly connected to a seating tool, and a lower end of the tie rod is connected to an internal thread of a base;

the tie rod is located at a center of a shaft; the locking joint, the expansion head, the sealing tube, the cone and the slip are sequentially set on the tie rod;

the expansion head is of a cylindrical structure, an upper end hole of the expansion head is an inner cone hole of the expansion head, an upper outer surface of the expansion head is a cylindrical surface, a lower outer surface of the expansion head is an outer conical surface of the expansion head; a lower end of the locking joint cooperates with the inner cone hole of the expansion head;

the sealing tube is of a cylindrical structure; the interior of the sealing tube is provided with a first inner conical surface, a first inner cylinder, a second inner conical surface, and a second inner cylinder in order from an upper end to a lower end; the first inner conical surface and the second inner conical surface have the same taper angle; an upper end of an outer surface of the sealing tube is an outer conical surface of the sealing tube, and a lower end of the sealing tube is an outer cylinder; the first inner conical surface is set on the outer conical surface of the expansion head; the lower end of the sealing tube is sleeved within an annular tab at an upper end of the cone;

the cone is of a cylindrical structure; a lower part of the cone is inserted into a conical hole at an upper end of the slip, making a plurality of cutouts uniformly cut along a circumferential direction of an outer surface of the slip; a tab at a lower end of the slip is limited by the base.

2. The all-metal dissolvable ball seat for self-compensating fracturing according to claim 1, wherein the expansion head, the sealing tube, the cone, the slip, and the base are made of magnesium-based and aluminum-based soft metal materials that are dissolvable in water.

3. The all-metal dissolvable ball seat for self-compensating fracturing according to claim 1, wherein a plurality of grooves are disposed at an outer side of an outer conical surface of the sealing tube.

* * * * *